United States Patent [19]

Tuthill

[11] 3,950,933

[45] Apr. 20, 1976

[54] CABLED OR WRAPPED, STUFFER BOX CRIMPED YARN AND METHOD OF PRODUCING THE SAME

[75] Inventor: Royal P. Tuthill, Newton, Pa.

[73] Assignee: Concorde Fibers Inc., Columbia, Md.

[22] Filed: Feb. 15, 1974

[21] Appl. No.: 443,059

[52] U.S. Cl. ..... 57/140 R; 57/160

[51] Int. Cl.[2] ..... D02G 3/28; D02G 3/02

[58] Field of Search ..... 57/140 BY, 144, 160, 57/140 R, 156, 153

[56] References Cited

UNITED STATES PATENTS

| | | | |
|---|---|---|---|
| 2,134,022 | 10/1938 | Bell | 57/140 BY |
| 2,145,346 | 1/1939 | Dreyfus | 57/140 BY |
| 2,199,428 | 5/1940 | Finlayson et al. | 57/140 BY |
| 2,199,429 | 5/1940 | Finlayson et al. | 57/140 BY |
| 3,309,855 | 3/1967 | Stoll et al. | 57/140 BY X |
| 3,365,875 | 1/1968 | Hall | 57/140 BY |
| 3,427,647 | 2/1969 | Field | 57/140 BY X |
| 3,438,193 | 4/1969 | Kosaka et al. | 57/140 BY X |
| 3,460,336 | 8/1969 | Collingwood et al. | 57/140 BY |

*Primary Examiner*—Donald E. Watkins
*Attorney, Agent, or Firm*—Nolte and Nolte

[57] ABSTRACT

A stuffer box crimped yarn of lengthwise uniformity in appearance is produced by twisting together or, more specifically, cabling at least three multifiliment ends, at least one of the ends being of a different color, initial twist or initial texture from at least one other of the ends, or by twisting together, that is, wrapping, two stuffer box crimped multifilament ends, at least one of the ends having an initial twist, the ends being of different colors, initial twists or initial textures.

17 Claims, 1 Drawing Figure

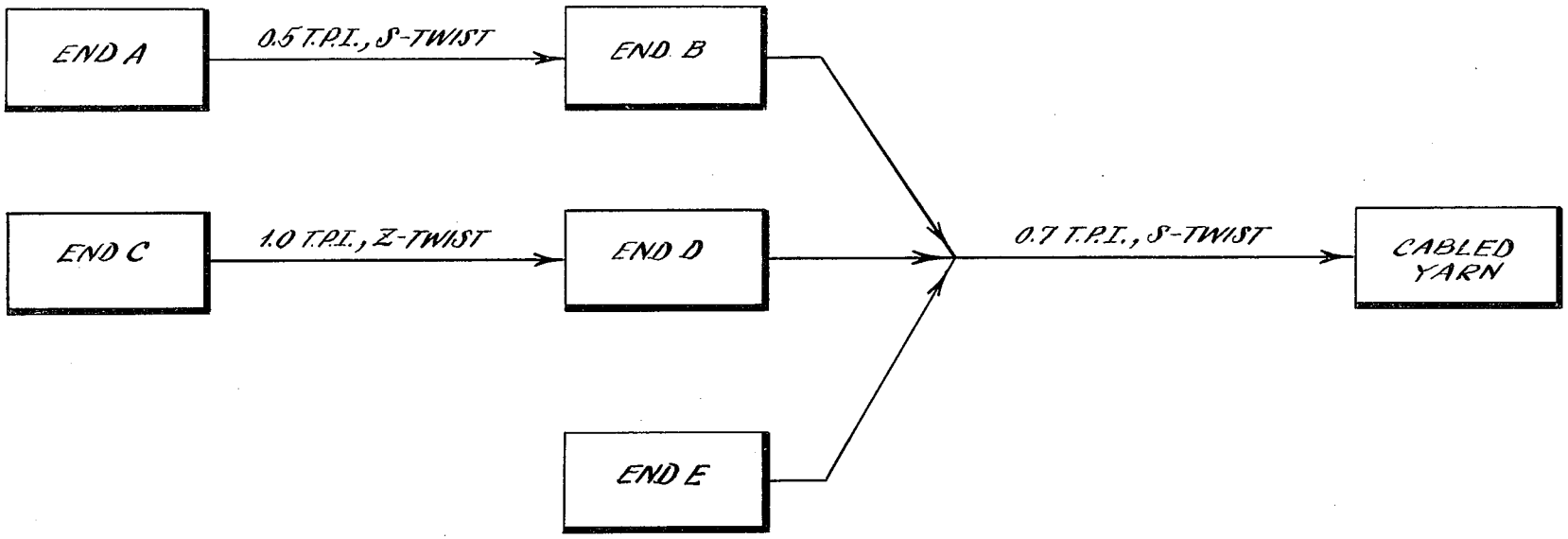
END A
0.5 T.P.I., S-TWIST
END B
END C
1.0 T.P.I., Z-TWIST
END D
END E
0.7 T.P.I., S-TWIST
CABLED YARN

CABLED OR WRAPPED, STUFFER BOX CRIMPED YARN AND METHOD OF PRODUCING THE SAME

This invention relates to a method of producing a stuffer box crimped yarn of lengthwise uniform appearance and to the resultant yarn.

Stuffer box crimping is a well known form of crimping in which a yarn in a permanently deformable state is folded upon itself whereby a crimp is imparted to the yarn. A stuffer box crimped yarn is visually distinguishable to one skilled in the art from other crimped yarns such as gear crimped yarns, knit-deknit crimped yarns, jet crimped yarns, knife edge crimped yarns and false twist crimped yarns. To those skilled in the art, therefore, "stuffer box crimped" not only describes a process by which a yarn has been crimped but also the crimped yarn itself. While stuffer box crimped yarn has a desirable bulkiness which renders it particularly suitable for many uses including the pile of carpeting, a disadvantage of stuffer box crimped yarn is the presence of "shiners," which are lengthwise segments of the crimped yarn in which the crimps in adjacent filaments are in registry causing such segments of the yarn to reflect more light than other segments of the yarn. For many textile products, including much carpeting, this is considered to be an undesirable characteristic. Another lengthwise non-uniformity occuring from time to time in many dyed or pigmented yarns are color variations. Also, in stuffer box crimped yarns, as in other crimped or texturized yarns, lengthwise non -uniformities in bulk or texture, apart from shiners, occur from time to time.

It is an object of the present invention to eliminate, or, more precisely, to conceal, such non-uniformities in stuffer box crimped yarn.

According to the invention there is provided a method of producing a twisted, or, more precisely, cabled or wrapped, stuffer box crimped yarn of lengthwise uniform appearance. In the resultant novel cabled or wrapped yarn according to the invention the cabling or wrapping conceals the aforementioned types of non-uniformities. Cabling is to be understood here as the twisting together of at least three groups of filaments, at least one of the groups of filaments having an initial S-twist and at least one other of the groups of filaments having an initial Z-twist, the resultant groups of filaments or ends being held together by S- or Z-twist applied to the combined ends. Wrapping is to be understood here as the twisting together of two groups of filaments, at least one group or end having an initial twist.

The method of producing a cabled, stuffer box crimped yarn of lengthwise uniform appearance of the present invention comprises twisting together in one sense at least a first stuffer box crimped multifilament end and a second stuffer box crimped multifilament end and twisting the twisted together ends together in the opposite sense with at least a third stuffer box crimped multifilament end, at least one of the ends being of a different color, initial twist or initial texture from at least one other of the ends. The resultant cabled yarn of lengthwise uniform appearance of the invention comprises at least three stuffer box crimped multifilament ends twisted together and containing respective sets of filaments twisted in opposite senses and at leeast one of the ends being of a different color, twist or texture from at least one other of the ends.

Similarly, the method of producing a wrapped, stuffer box crimped yarn of lengthwise uniform appearance of the present invention comprises twisting together two stuffer box crimped multifilament ends, at least one of the ends having an initial twist, the ends being of different colors, initial twists or initial textures. The resultant wrapped yarn of lengthwise uniform appearance of the invention comprises two stuffer box crimped multifilament ends twisted together, the filaments of at least one of the ends containing twist in addition to that imparted by the twisting together of the ends and the ends being of different color, twist or texture.

"Initial twist" refers to a twist imparted to an individual multifilament end preliminary to the twisting together of that end with other multifilament ends according to the invention. When an end is not preliminarily twisted, it is considered to have an initial twist of zero. "Initial texture" refers to the bulkiness of an individual multifilament end before it is twisted together with other multifilament ends according to the invention. The texture or bulkiness of the respective ends may be varied by conventional adjustments in the operating parameters of the stuffer box crimper. The consequence of the aforementioned difference between ends in color and/or initial twist and/or initial texture, which may be referred to herein as "different appearance" together with the cabling or wrapping is to conceal any lengthwise non-uniformities in color or texture, including the presence of shiners, and, thereby, produce a cabled, or wrapped stuffer box crimped yarn of lengthwise uniform appearance.

In any pre-twisting of the individual ends or twisting together of the ends, it is preferred to employ levels of twist of about 0.5 to about 10 turns per inch. Moreover, it is preferred that the final cabled or wrapped yarn contain filaments having a twist of about 0.5 to about 10 turns per inch. The cabled yarn is to contain filaments having a twist in one sense and filaments having a twist in the opposite sense, each such twist preferably being on the order of about 0.5 to about 10 turns per inch. It is preferred that the total denier of the cabled or wrapped yarn be about 2,000 to about 20,000. The denier per filament in the cabled or wrapped yarn may be in the range of about 3 to about 50. These parameters are selected from the viewpoint of most effectively attaining the objects of the invention.

The twisting operations may be conducted on any conventional twisters such as uptwisters and downtwisters.

The following examples, the first of which is to be considered in conjunction with the drawing, a schematic illustration of the process of the first example, are further illustrative of the invention.

EXAMPLE 1

A 72 filament/2650 denier stuffer box crimped end (end A in drawing) constituted equally of yellow, mustard, champagne and gold polypropylene filaments is twisted with 0.5 turn per inch of S-twist to form a twisted end of 2600 denier (End B in drawing). A like end (End C in drawing) is twisted with 1.0 turn per inch of Z-twist to form another twisted end of 2600 denier (End D in drawing). A 72 filament/2650 denier initially untwisted end (End E in drawing) constituted of 18 orange, 18 mustard and 36 black polypropylene filaments is twisted together with the aforementioned two twisted ends with 0.7 turn per inch of S-twist to form a twisted (or, more specifically, cabled, since it contains S-twist and Z-twist) yarn of 7800 denier. The yarn is of uniform lengthwise appearance and is tufted into a backing on a conventional tufting machine to form carpeting.

EXAMPLE 3

A 72 filament/2650 denier stuffer box crimped end constituted equally of yellow, mustard, champagne and gold polypropylene filaments is twisted with 1.5 turns per inch of Z-twist to form a twisted end of 2600 denier. A 72 filament/2650 denier untwisted end constituted of 18 orange, 18 mustard and 36 black polypropylene filaments is twisted together with the other end with 0.7 turn per inch of S-twist to form a wrapped yarn of 5200 denier. The yarn is of uniform lengthwise appearance and is tufted into a backing on a conventional tufting machine to form carpeting.

What is claimed is:

1. Method of producing a cabled, stuffer box crimped yarn of lengthwise uniform appearance comprising twisting together in one sense at least a first stuffer box crimped multifilament end and a second stuffer box crimped multifilament end and twisting the twisted together ends together in the opposite sense with at least a third stuffer box crimped multifilament end, at least one of said ends being of a different appearance from at least one other of said ends.

2. Method according to claim 1, in which the total denier of all the twisted together ends is about 2000 to about 20,000.

3. Method according to claim 2, in which each twisting is about 0.5 to about 10 turns per inch, the different appearance comprises different initial twist, the amount of twist in any pre-twisted end is about 0.5 to about 10 turns per inch and the final yarn contains filaments having a twist of about 0.5 to about 10 turns per inch in one sense and filaments having a twist of about 0.5 to about 10 turns per inch in the opposite sense.

4. Method according to claim 3, in which all of the filaments are of about 3 to about 50 denier per filament.

5. A cabled yarn of lengthwise uniform appearance comprising at least three stuffer box crimped multifilament ends twisted together and containing respective sets of filaments twisted in opposite senses and at least one of the ends being of a different appearance from at least one other of the ends.

6. Yarn according to claim 5 having a total denier of about 2,000 to about 20,000.

7. Yarn according to claim 6, in which all twist is of about 0.5 to about 10 turns per inch.

8. Yarn according to claim 7, in which all of the filaments are of about 3 to about 50 denier per filament.

9. Method of producing a wrapped, stuffer box crimped yarn of lengthwise uniform appearance comprising twisting together two stuffer box crimped multifilament ends, at least one of the ends having an initial twist, the ends being of different appearance.

10. Method according to claim 9, in which also the second stuffer box crimped multifilament end has an initial twist.

11. Method according to claim 9, in which the total denier of the twisted together ends is about 2000 to about 20,000.

12. Method according to claim 11, in which all twist is of about 0.5 to about 10 turns per inch.

13. Method according to claim 12, in which all of the filaments are about 3 to about 50 denier per filament.

14. A wrapped yarn of lengthwise uniform appearance comprising two stuffer box crimped multifilament ends twisted together at least one of the ends containing twist in addition to that imparted by the twisting together of the ends and the ends being of different appearance.

15. Yarn according to claim 14, having a total denier of about 2,000 to about 20,000.

16. Yarn according to claim 15, in which all twist is of about 0.5 to about 10 turns per inch.

17. Yarn according to claim 16, in which all of the filaments are of about 3 to about 50 denier per filament.

* * * * *